US009127479B2

(12) United States Patent
Romero et al.

(10) Patent No.: US 9,127,479 B2
(45) Date of Patent: Sep. 8, 2015

(54) REKEYABLE LOCK SYSTEM

(71) Applicant: KWIKSET CORPORATION, Lake Forest, CA (US)

(72) Inventors: Oscar Romero, Lake Forest, CA (US); John C. Charnley, Newcastle Upon Tyne (GB)

(73) Assignee: Kwikset Corporation, Lake Forest, CA (US)

( * ) Notice: Subject to any disclaimer, the term of this patent is extended or adjusted under 35 U.S.C. 154(b) by 226 days.

(21) Appl. No.: 13/956,959

(22) Filed: Aug. 1, 2013

(65) Prior Publication Data

US 2014/0069156 A1 Mar. 13, 2014

Related U.S. Application Data

(60) Provisional application No. 61/680,035, filed on Aug. 6, 2012.

(51) Int. Cl.
*E05B 29/04* (2006.01)
*E05B 27/00* (2006.01)

(52) U.S. Cl.
CPC ..... *E05B 27/005* (2013.01); *E05B 27/0082* (2013.01); *Y10T 70/7746* (2015.04)

(58) Field of Classification Search
CPC ..... E05B 15/14; E05B 15/143; E05B 27/005; E05B 27/0053; E05B 29/004; E05B 29/0046; E05B 2015/146
USPC ..... 70/336, 337, 340, 341, 342, 343, 382, 70/383, 384, 385, 495, 496
See application file for complete search history.

(56) References Cited

U.S. PATENT DOCUMENTS

| | | | | |
|---|---|---|---|---|
| 2,194,469 | A * | 3/1940 | Fremon | 70/493 |
| 5,233,850 | A * | 8/1993 | Schroeder | 70/337 |
| 5,421,179 | A * | 6/1995 | Bergstrom | 70/369 |
| 5,640,865 | A * | 6/1997 | Widen | 70/495 |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,951,123 | B2 | 10/2005 | Chong | |
| 6,959,569 | B2 | 11/2005 | Strader et al. | |
| 6,973,813 | B2 | 12/2005 | Erdely | |

(Continued)

OTHER PUBLICATIONS

Intellectual Property Office, Great Britain; Combined Search and Examination Report; Feb. 18, 2014.

*Primary Examiner* — Christopher Boswell
(74) *Attorney, Agent, or Firm* — Barnes & Thornburg LLP

(57) ABSTRACT

A rekeyable lock cylinder includes a cylinder body and a plug assembly, which includes key followers normally biased for linear movement into a home position. Locking bar interfaces in the plug assembly are rotatably connected to respective key followers for simultaneous linear movement with the key followers, and are movable from a non-rotatable to a rotatable position within the plug assembly. Each interface defines a plurality of angularly-spaced unlocking cavities alignable with a locking bar operatively associated with the cylinder body and plug assembly. When the user causes the interface to move into the rotatable position, it can be rotated to re-align any or all of the unlocking cavities with the locking bar. Inasmuch as each unlocking cavity is also associated with a particular elevation of the interface's respective key follower, re-aligning one or more such cavities resets the respective elevations of the key followers so that they can accept only a different valid key.

40 Claims, 18 Drawing Sheets

(56) References Cited

U.S. PATENT DOCUMENTS

| | | | | |
|---|---|---|---|---|
| 7,007,528 | B2 | 3/2006 | Chong et al. | |
| 7,114,357 | B2 | 10/2006 | Armstrong et al. | |
| 7,117,701 | B2 | 10/2006 | Armstrong et al. | |
| 7,213,429 | B2 | 5/2007 | Armstrong et al. | |
| 7,234,331 | B2 | 6/2007 | Armstrong et al. | |
| 7,308,811 | B2 | 12/2007 | Armstrong et al. | |
| 7,322,219 | B2 | 1/2008 | Armstrong et al. | |
| 7,434,431 | B2 | 10/2008 | Armstrong et al. | |
| 7,634,931 | B2 | 12/2009 | Segien et al. | |
| 7,878,036 | B2 | 2/2011 | Armstrong et al. | |
| 7,900,491 | B2 * | 3/2011 | Chong | 70/492 |
| 7,975,518 | B2 * | 7/2011 | Chiang et al. | 70/383 |
| 8,033,150 | B2 | 10/2011 | Armstrong et al. | |
| 8,099,988 | B1 | 1/2012 | Wheatland | |
| 8,291,735 | B1 | 10/2012 | Damikolas | |
| 8,316,676 | B2 * | 11/2012 | Chiang et al. | 70/383 |
| 8,347,678 | B2 | 1/2013 | Chong | |
| 8,621,902 | B2 * | 1/2014 | Mathachan | 70/492 |
| 8,646,299 | B2 * | 2/2014 | Sloth | 70/493 |
| 8,656,747 | B2 | 2/2014 | Armstrong et al. | |
| 8,893,536 | B2 * | 11/2014 | Huang et al. | 70/383 |
| 2013/0086957 | A1 | 4/2013 | Emory | |
| 2014/0041429 | A1 | 2/2014 | Zhang | |

* cited by examiner

REKEYABLE LOCK SYSTEM

RELATED APPLICATIONS

The present application is related to and claims priority to U.S. Provisional Patent Application Ser. No. 61/680,035, filed on Aug. 6, 2012, entitled "Rekeyable Lock System." The subject matter disclosed in that provisional application is hereby expressly incorporated into the present application.

TECHNICAL FIELD

The present invention relates generally to lock cylinders and particularly to lock cylinders that can be rekeyed. More particularly, the present invention relates to rekeyable lock cylinders that do not require disassembly to be rekeyed.

BACKGROUND OF THE INVENTION

It is well known that being able to rekey a lock cylinder without disassembly saves a significant amount of time. It also eliminates having to carry around a large collection of parts. However, conventional rekeyable lock systems that accomplish this objective exhibit disadvantages of their own. One such system requires key followers having a plurality of gear teeth for engagement with respective toothed racks mounted in a carrier. During the rekeying process, a first valid key is inserted into the keyway and rotated. The user then manually pushes the carrier parallel to the longitudinal axis of the lock cylinder until the racks are disengaged from the key followers. The first valid key is removed and a second valid key is inserted and rotated to allow the carrier to be biased back to its starting position, thereby re-engaging the rack teeth at new positions with the teeth on respective key followers. This lateral re-engagement of rack teeth with key follower teeth could result in a rekeying process that isn't as smooth as desired. Also, this known rekeyable system uses a lot of parts, namely the plurality of toothed racks, the rack carrier and the rack return spring, plus a spring catch and a spring-biased detent ball, among others.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

SUMMARY OF THE INVENTION

The present invention overcomes these and other disadvantages. The lock cylinder of the present invention is a totally different system that eliminates the problem of laterally-meshing teeth, because there are no teeth. There are no toothed key followers, no axially-moving racks, no carriers and, aside from the key follower and locking bar springs, there are no springs or spring catches. Furthermore, the user doesn't need to insert and rotate any keys to initiate and continue the rekeying process.

According to the rekeyable lock system of the present invention, a rekeyable lock cylinder includes a cylinder body and a plug assembly disposed in the cylinder body. The plug assembly includes a plurality of key followers normally biased for linear movement into a home position. A plurality of first locking elements, or locking bar interfaces, in the plug assembly are rotatably connected to respective key followers for simultaneous linear movement with the key followers.

The interfaces are movable from a non-rotatable to a rotatable position within the plug assembly. Each of the interfaces defines a plurality of angularly-spaced unlocking cavities or surfaces alignable with a second locking element, or locking bar, operatively associated with the cylinder body and the plug assembly. When the user causes the locking bar interface to move into the rotatable position, it can be rotated to re-align any or all of its unlocking cavities with the locking bar. Inasmuch as each of the plurality of unlocking cavities is also associated with a particular elevation of the interface's respective key follower, aligning one or more such cavities resets the respective elevations of the key followers so that they can accept only a different valid key.

As a result, the rekeyable lock system of the present invention further uses a new method of rekeying a rekeyable lock cylinder as follows: pushing at least one locking bar interface from its non-rotatable to its rotatable position against the bias of its respective key follower; rotating the interface to align a different unlocking surface with the locking bar, thereby moving its respective key follower to a different elevation; and allowing the interface to return to its non-rotatable position.

According to one aspect of the present invention, a locking bar interface for a rekeyable lock cylinder having a locking bar and a key follower includes an elongated body, the body having an annular portion rotatably engageable with a key follower, and a polygonal portion spaced from the annular portion, the polygonal portion defining a rotation-preventing surface and an array of cavities operatively associated with the locking bar.

According to another aspect of the present invention, a key follower for a lock cylinder includes a cylindrical body defining a spring-receiving recess at one end and a spring-stop adjacent the other end; and a connector formed on one side of the body.

According to yet another aspect of the present invention, a key follower and locking bar interface subassembly for a lock cylinder includes a key follower having a cylindrical body and a connector formed thereon; and a locking bar interface coupled to the key follower for rotation within the connector, the locking bar interface being operatively associated with a locking bar.

Other features and advantages of the present invention will become apparent from the following description when viewed in accordance with the accompanying drawings and appended claims.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the rekeyable lock system, and such exemplification is not to be construed as limiting the scope of the rekeyable lock system in any manner.

DETAILED DESCRIPTION OF THE DRAWINGS

Figure 1:
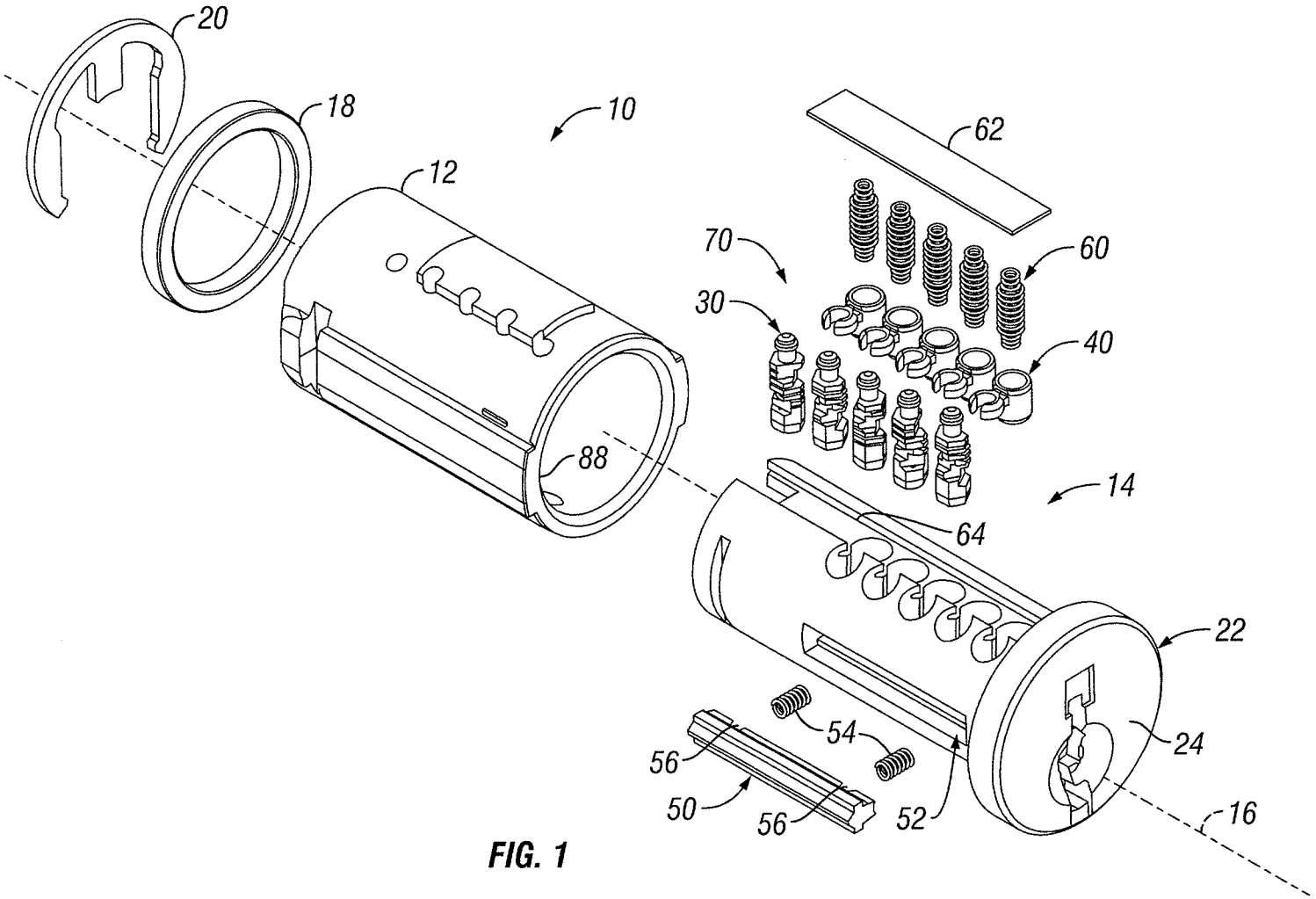
FIG. 1 is an exploded view of the rekeyable lock cylinder of the lock system of the present invention.
Figure 2:
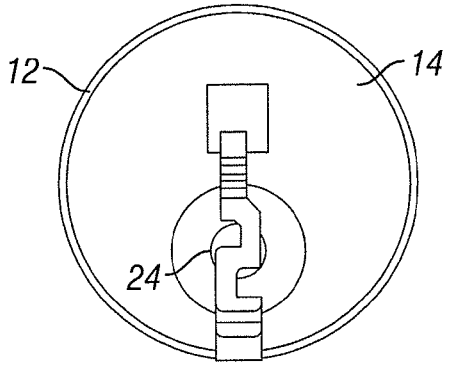
FIG. 2 is a front elevational view of the assembled lock cylinder of FIG. 1.
Figure 3:
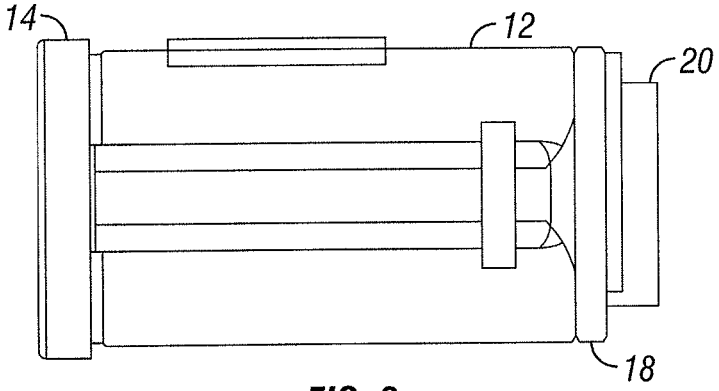
FIG. 3 is a side elevational view of the lock cylinder of FIG. 2.
Figure 4:
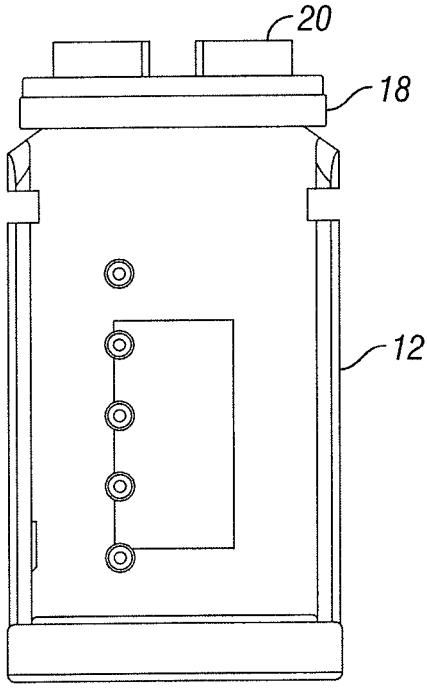
FIG. 4 is a top plan view of the lock cylinder of FIG. 2.

The present disclosure is directed to:

One embodiment of a lock cylinder of the rekeyable lock system of the present invention is shown generally as 10 in the exploded view of FIG. 1; it is shown in FIGS. 2-4 in the assembled state. The lock cylinder 10 includes a lock cylinder body 12, a plug assembly 14 defining a longitudinal axis 16, a spacer 18 and a retainer 20.

The plug assembly 14 of the present invention, as seen in FIG. 1, includes a plug body 22 having a key face 24, an array of first locking elements or locking bar interfaces 30 rotatably connected for simultaneous linear movement with respective key followers 40 and operatively associated with a second locking element or locking bar 50. The locking bar 50 is mounted in a locking bar cavity 52 formed in the plug body 22, and is normally biased radially outwardly by locking bar springs 54 in spring cavities 56 in the locking bar. The locking bar 50 further defines a cylinder wall-engaging portion 57 and an interface-engaging portion 58. The locking bar 50 is operatively associated with the plug body 22 and lock cylinder body 12 to normally maintain the plug body in the locked position, as will be described in more detail below. The key followers 40, and consequently the interfaces 30, are normally biased into a home position by key follower springs 60.

The last few coils at each end of the springs 60 have reduced diameters, which create greater spring force in a smaller physical height than could be achieved if the springs were of a constant diameter. A spring cap 62 mounted in a spring cap groove 64 retains the springs 60 in a place in the plug body 22.

A quick insight into the unique arrangement of the elements of the rekeyable lock cylinder 10 of the present invention can be gained from a review of FIGS. 13-16. These illustrate an array of five key follower-interface subassemblies 70. However, as would be apparent to one of ordinary skill in the art, the present invention contemplates the use of one or more such subassemblies 70, where the fewer the number in the array, the less robust the security. The greater the number in the array, the more robust the security.

As will be described in greater detail, the interfaces 30 are rotatably connected to the key followers 40 for simultaneous linear movement with the key followers in the plug body 22, so that the vertical height of a particular interface 30 will determine the vertical height of its respective key follower 40, and vice-versa. The structure of the interface 30 enables a much simplified method for raising and lowering each subassembly 70 to provide fast, reliable rekeying of the plug assembly 14 of the present invention. With continued reference to FIGS. 13-16, and further with reference to FIGS. 26A-28B, in one embodiment of the lock cylinder 10 of the present invention, each interface 30 includes an annular portion 31 and a polygonal portion 32. Although a polygonal portion 32 in the form of a hexagonal solid is illustrated in FIGS. 26A-28B, it will be appreciated that any non-circular cross-section can be substituted in its place, as long as it is capable of interacting (as will be later described) with the plug body 22 to prevent the interface 30 from rotating and with the locking bar 50 to allow or prevent movement of the locking bar out of its cavity 52 in the plug body.

Figure 27A:
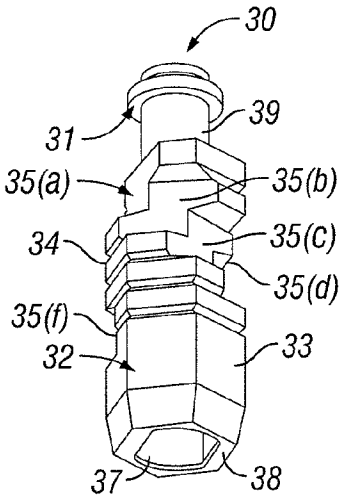
FIGS. 27A and 27B are enlarged perspective and side elevational detail views, respectively, of the locking bar interface of FIGS. 26A and 26B, illustrating one unlocking cavity per face.
Figure 27B:
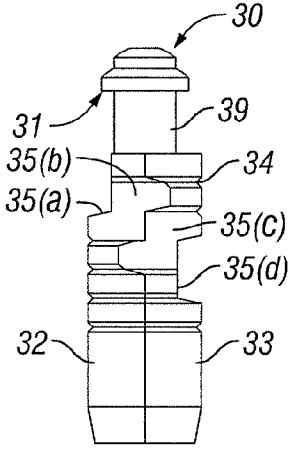
Figure 26A:
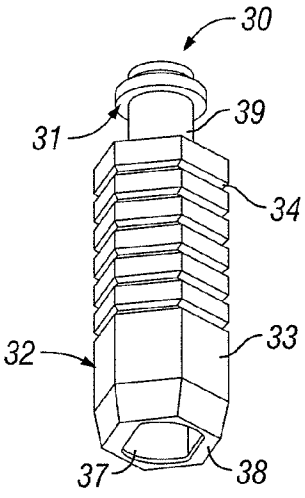
FIGS. 26A and 26B are enlarged perspective and side elevational detail views, respectively, of a locking bar interface of the present invention, showing no unlocking cavities, but illustrating small anti-pick 'V' grooves at the midpoints where the locking cavities would be formed.
Figure 26B:
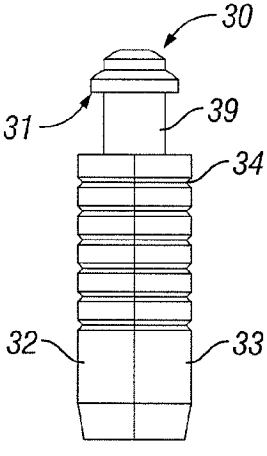

Referring now specifically to FIGS. 26A and 26B, the polygonal portion 32 defines six faces 33, each of which in turn defines six vertically-spaced anti-pick "V"-grooves 34. Although six faces 33 are disclosed in this embodiment of the present invention, it will also be appreciated that the polygonal solid may define fewer or greater numbers of faces capable of interacting with the plug body 22 to prevent rotating and with the locking bar 50 to allow or prevent movement of the locking bar out of its cavity in the plug body, The grooves 24 are horizontally centered with the centers of six unlocking cavities 35(*a*)-35(*f*) which are formed in respective faces 33 of the interface 30. The unlocking cavities 35(*a*)-35(*f*) are angularly and vertically spaced from one another, and are configured as shown in FIG. 27B at 35(*d*), for example, to accommodate locking bar 50. Thus, with reference to FIGS. 13 and 16, the angular position of a particular interface 30 with respect to locking bar 50 will determine whether that particular interface will allow the locking bar to move out of its cavity 52. In FIGS. 13-16, the subassemblies 70 are shown in the home or locked position, where not all of the cavities 35(*a*)-35(*f*) are aligned with the locking bar 50.

Figure 28A:
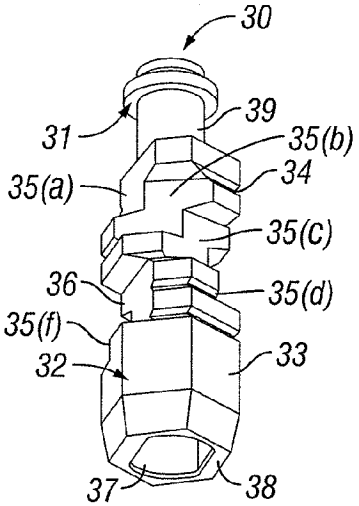
FIGS. 28A and 28B are enlarged perspective and side elevational detail views, respectively, of the locking bar interface of FIGS. 27A and 27B, illustrating the use of second unlocking cavity on a face for creating a master locking bar interface of the present invention.
Figure 28B:
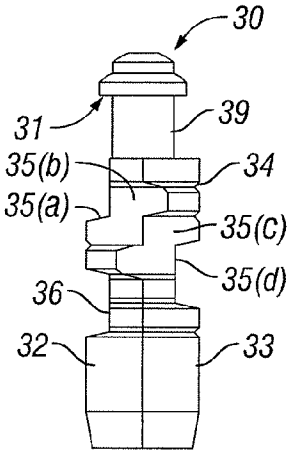

It will be noticed that the interfaces 30 of this embodiment of the lock cylinder 10 of the present invention are all formed identically. This is just one way the lock cylinders 10 of the present invention reduce the complexity and concomitant inventory of parts needed to assemble the cylinders 10. However, it can be appreciated that not all interfaces 30 need be formed alike. For example, as shown in FIGS. 28A and 28B, another embodiment is shown of the lock cylinder 10 of the present invention, as will be described later, which provides a master interface 30 by forming a master unlocking cavity 36 in any face 33 of the array of five interfaces 30. Yet a third unlocking cavity (not shown) may be formed at different key heights on any face 33 to create a Grand-Master interface, if desired.

Referring to FIGS. 8 and 26A, 27A, and 28A, a non-circular tool cavity 37 is formed in the bottom 38 of each interface 30. In addition, the annular portion 31 of each interface 30 defines a reduced-diameter cylindrical portion 39 rotatably engageable by a key follower 40. In this preferred embodiment, although the interfaces 30 are manufactured by injection molding sintered stainless steel, while maintaining tolerances of about ±0.001 inch, other suitable materials and processes may be used.

Now referring to FIGS. 9-12 and 13-15, the key follower 40 of the present invention is shown as a unitary plastic body, but as can be appreciated, it can be formed in more than one piece and manufactured of other materials. The key follower 40 is a cylindrical body defining a spring-receiving recess 42 at one end and a spring stop 44 at the other end. A connector 46 formed thereon includes a smaller cylindrical body having an annular wall 47, defining a gap 48 therein, so that the connector 46 can be engaged onto the reduced-diameter cylindrical portion 39 of an interface 30. The gap 48 creates arms 49 that permit rotation of the interface 30 relative to the key follower 40, while causing the subassembly 70, relative to the plug body 22, to move linearly as one unit.

Figure 5:
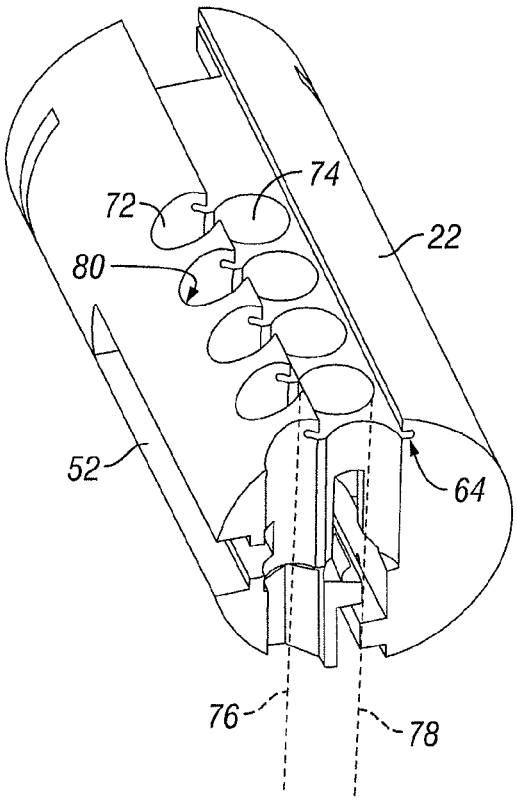
FIG. 5 is a top perspective view, partially cut away, of a cylinder plug of the lock cylinder of FIG. 1, illustrating the circular and non-circular portions of a cavity formed in the plug for receiving a locking bar interface of the present invention.
Figure 6:
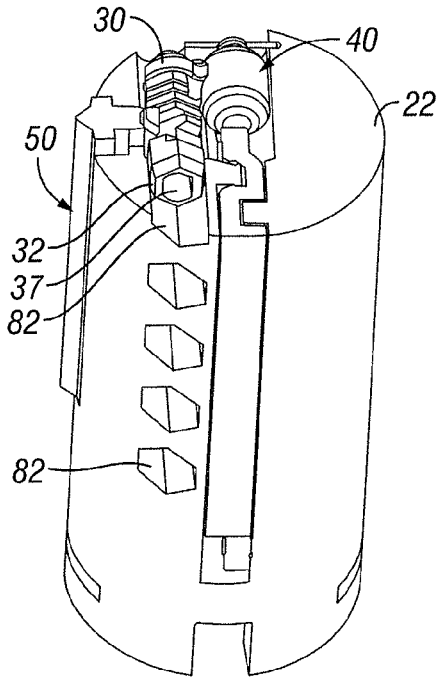
FIG. 6 is a bottom front perspective view, partially cut away, of the cylinder plug of FIG. 5 illustrating the locking bar interface of the present invention in a non-rotatable position in the non-circular portion of the cavity, and in juxtaposition with a locking bar, and further illustrating the relative position of a key follower of the present invention, with a first valid key being inserted in the keyway.
Figure 7:
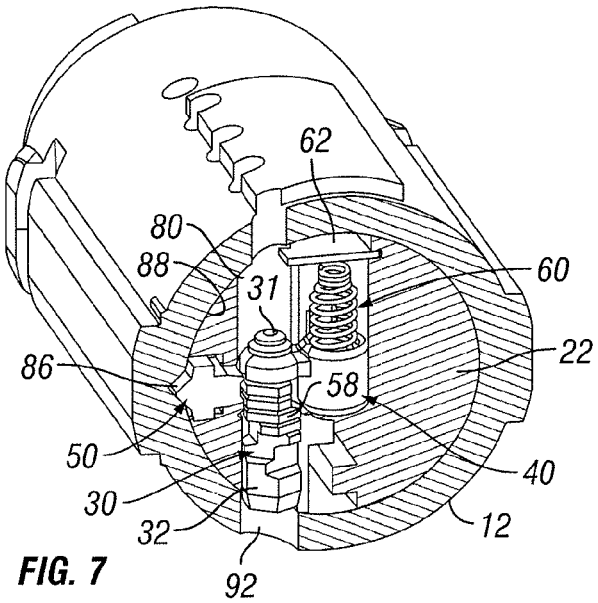
FIG. 7 is a top front perspective view, partially cut away, of the cylinder plug of FIG. 6 assembled into a lock cylinder of the present invention, but showing all components in the home position.
Figure 8:
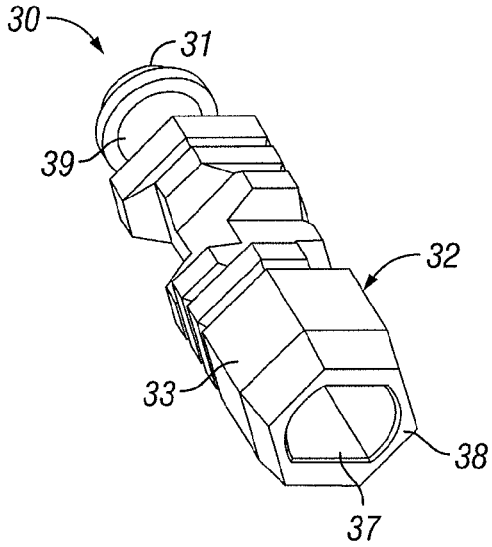
FIG. 8 is an enlarged bottom perspective detail view of a locking bar interface of the present invention.
Figure 9:
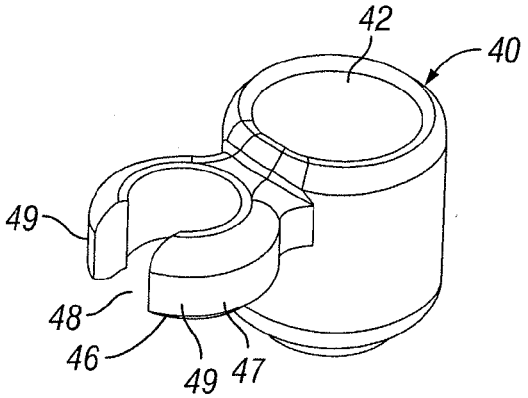
FIG. 9 is a top perspective view of a key follower of the present invention.
Figure 10:
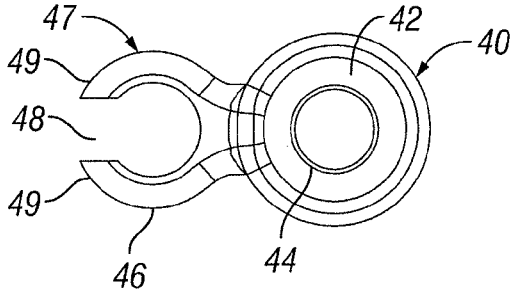
FIG. 10 is a top plan view of the key follower of FIG. 9.
Figure 11:
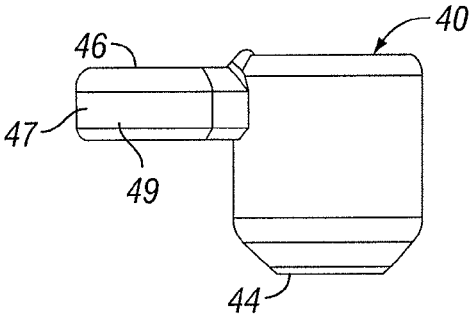
FIG. 11 is a side elevational view of the key follower of FIG. 9.
Figure 12:
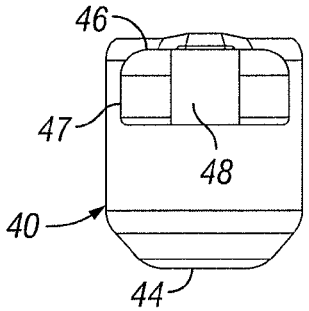
FIG. 12 is a front elevational view of the key follower of FIG. 9.
Figure 14:
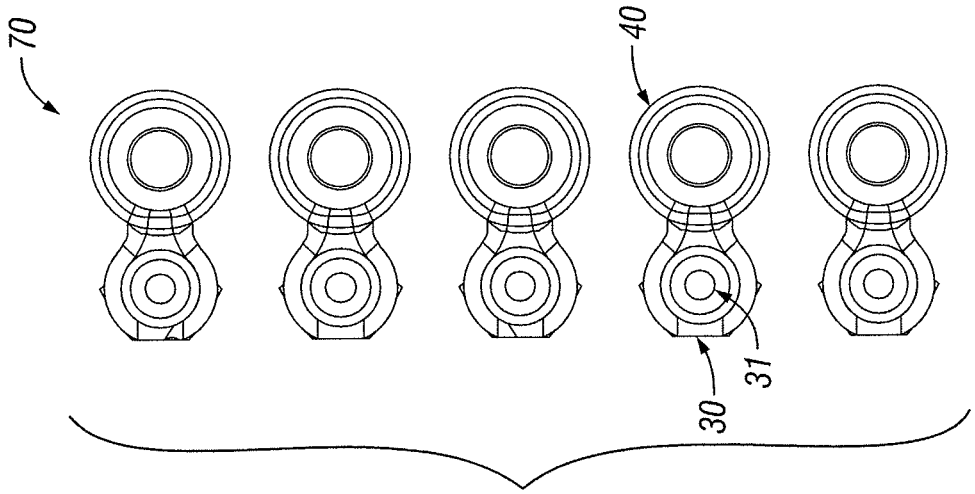
FIG. 14 is a top plan view of the array of FIG. 13.
Figure 13:
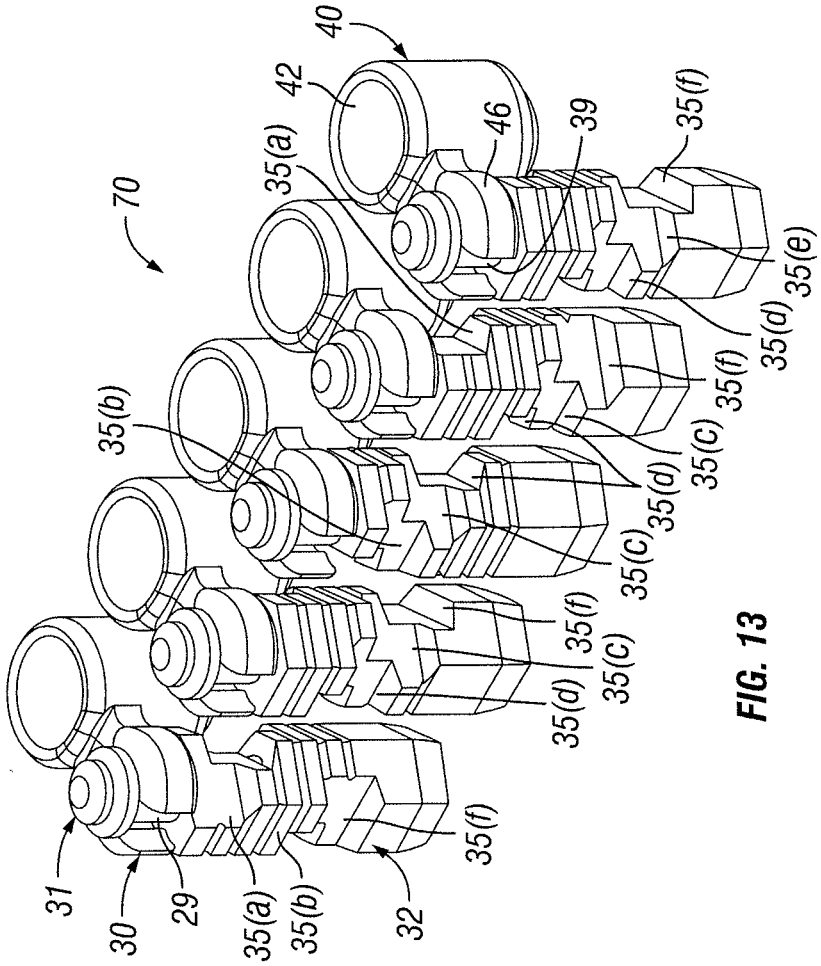
FIG. 13 is a top perspective schematic view of an array of five pin follower and locking bar interface subassemblies of the present invention, with several interfaces having been rotated with respect to their respective key followers to present a set of different unlocking cavities to a locking bar.
Figure 16:
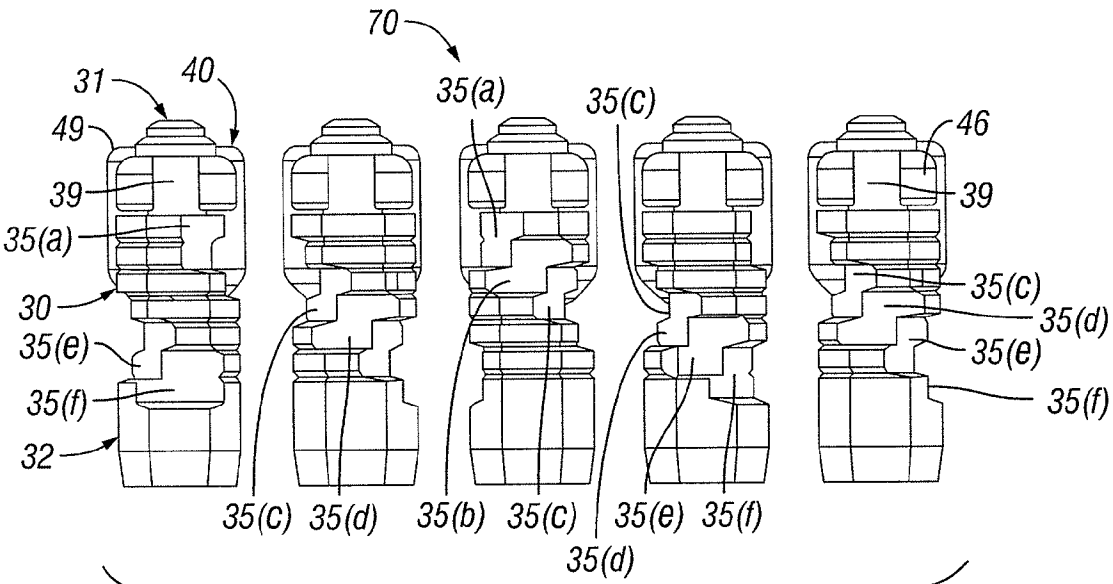
FIG. 16 is a front elevational view of the array of FIG. 13.
Figure 15:
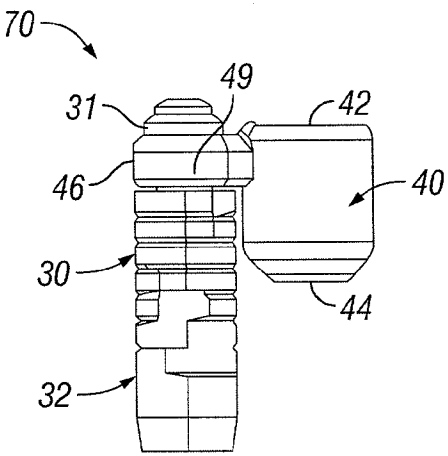
FIG. 15 is a side elevational view of the array of FIG. 13.
Figure 18:
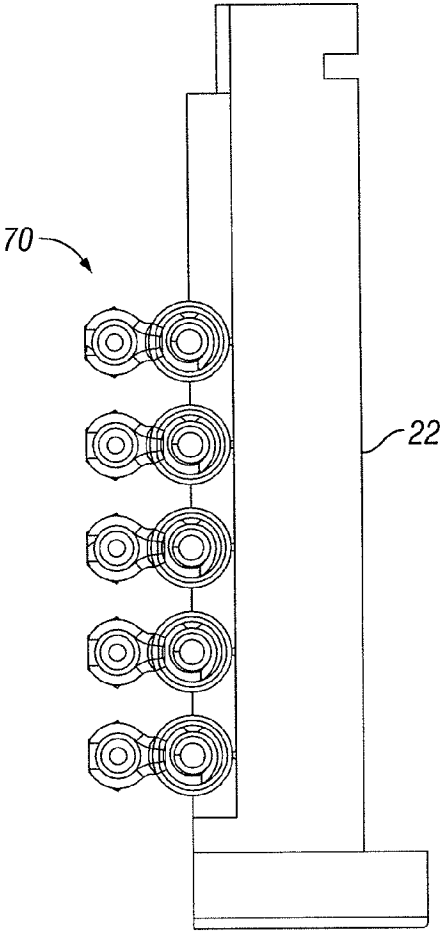
FIG. 18 is a top plan view of the plug assembly of FIG. 17.
Figure 17:
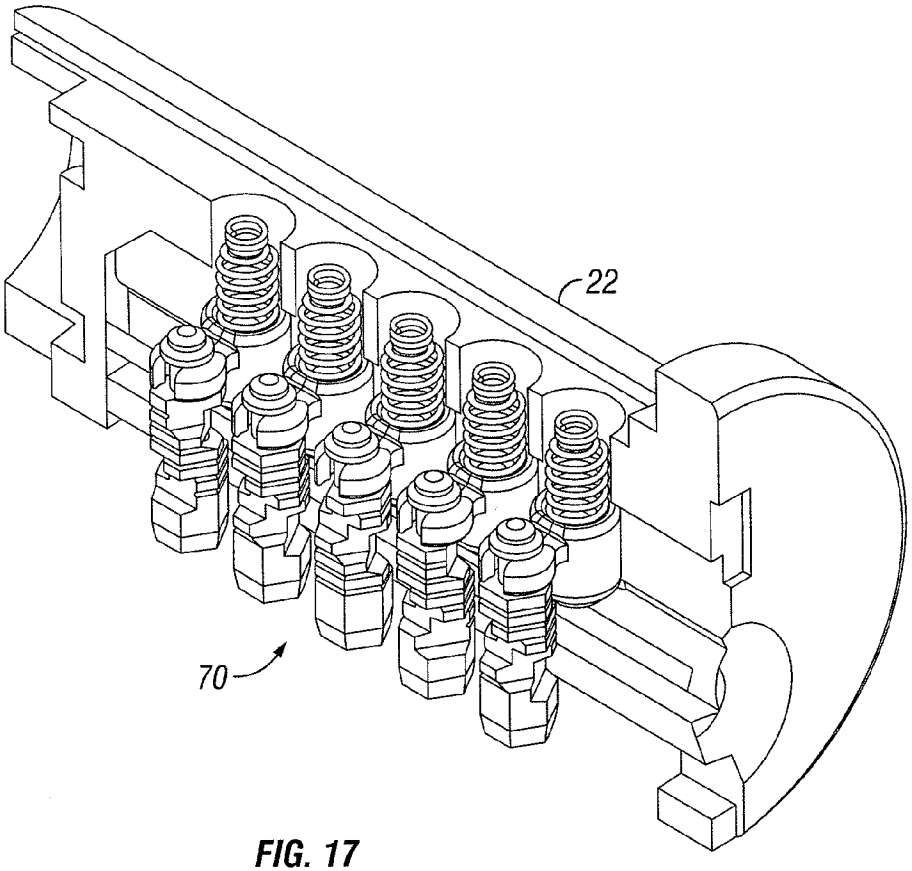
FIG. 17 is a partial cut-away perspective view of a plug assembly of the present invention illustrating the array of FIG. 13, with the plug follower springs in place, in the home position.
Figure 19:
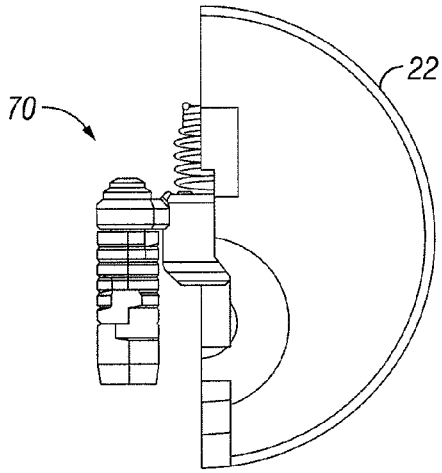
FIG. 19 is a front elevational view of the plug assembly of FIG. 17.
Figure 20:
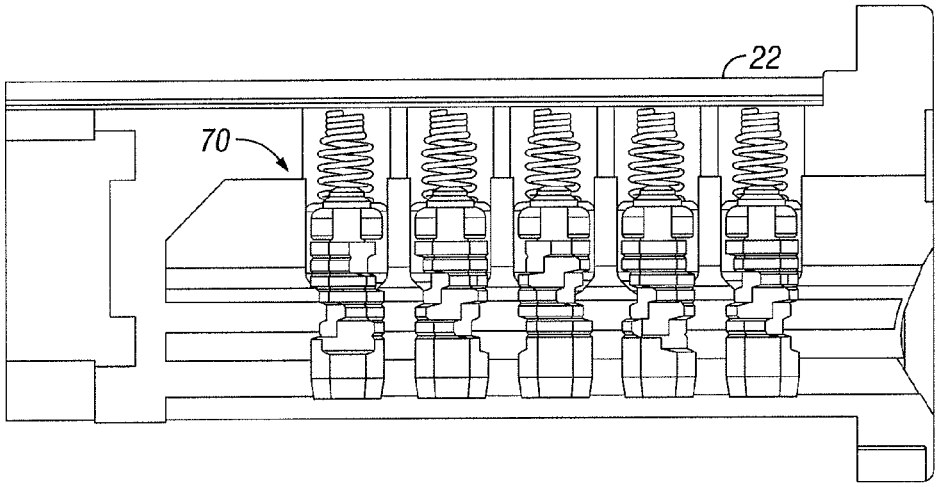
FIG. 20 is a side elevational view of the plug assembly of FIG. 17.
Figure 21:
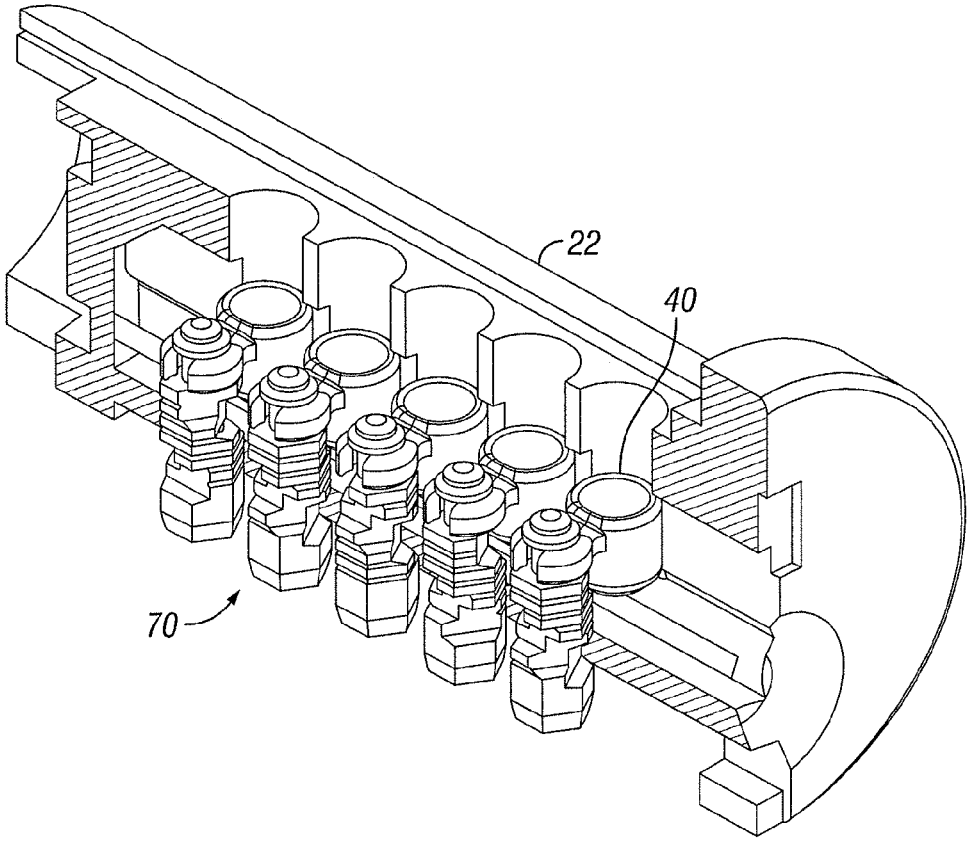
FIG. 21 is a partial cut-away perspective view of the plug assembly of the present invention, similar to FIG. 17, but with the springs removed.
Figure 22:
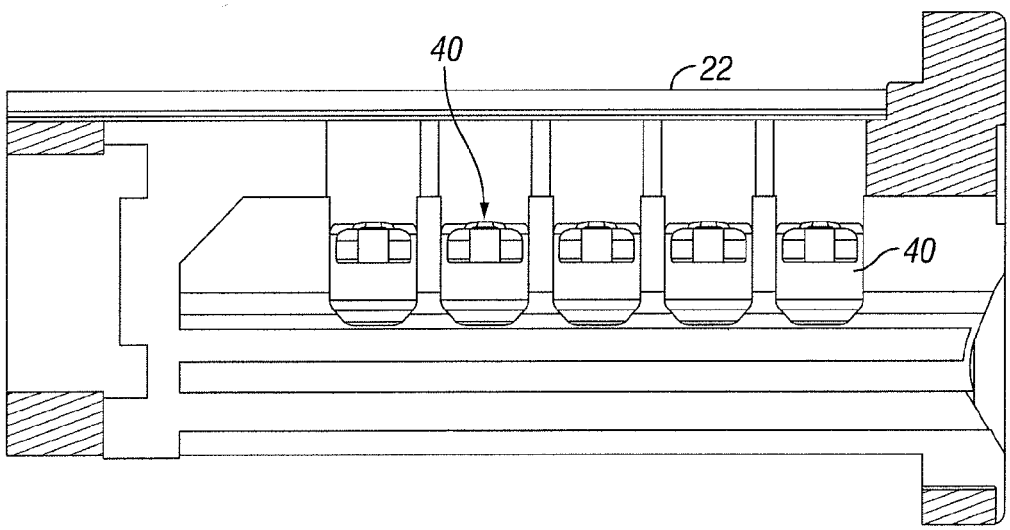
FIG. 22 is a partial side elevational view of the plug assembly of FIG. 21, with the locking bar interfaces removed.

The plug body 22 is formed in such a way as to permit or prohibit rotation of the interface 30. Referring to FIGS. 5-7, the plug body 22 itself five defines longitudinal interface cavities 72 and key follower cavities 74 for receiving respective key follower-interface subassemblies 70. The cavities 72 and 74 define longitudinal axes 76, 78 respectively, which are transverse to the plug axis 16. Although the key follower cavity 72 has an annular cross-section to slidingly receive a key follower 40 of the present invention, the interface cavity 74 includes two portions—an upper, annular cavity 80 having a predetermined length to allow rotation of the interface therein, and a lower, polygonal cavity 82 also having predetermined length and configured to conform to the shape of the polygonal portion 32 of the interface 30. In this embodiment of the present invention, both the polygonal cavity 82 and the interface polygonal portion 32 have six sides. Only when the interface 30 moves sufficiently up the interface cavity 80 so that the interface polygonal portion 32 clears the polygonal cavity 82, may the interface be rotated within the annular cavity 80. And, as noted above, as the interface 30 moves along the cavity 72, it simultaneously carries its respective key follower 40 with it for linear movement along axes 76, 78 transverse to the axis 16 of the plug body.

Figure 30:
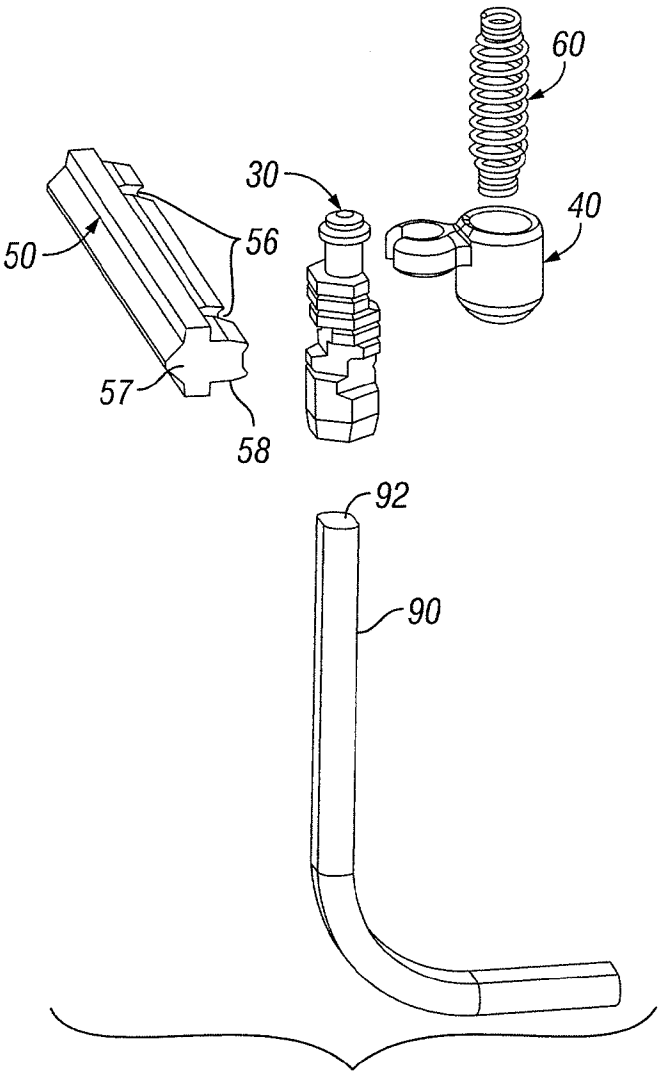
FIG. 30 is a top front schematic perspective view of a locking bar, locking bar interface, key follower, key follower spring and rekey tool of the present invention arrayed in an operative relationship with one another.
Figure 29:
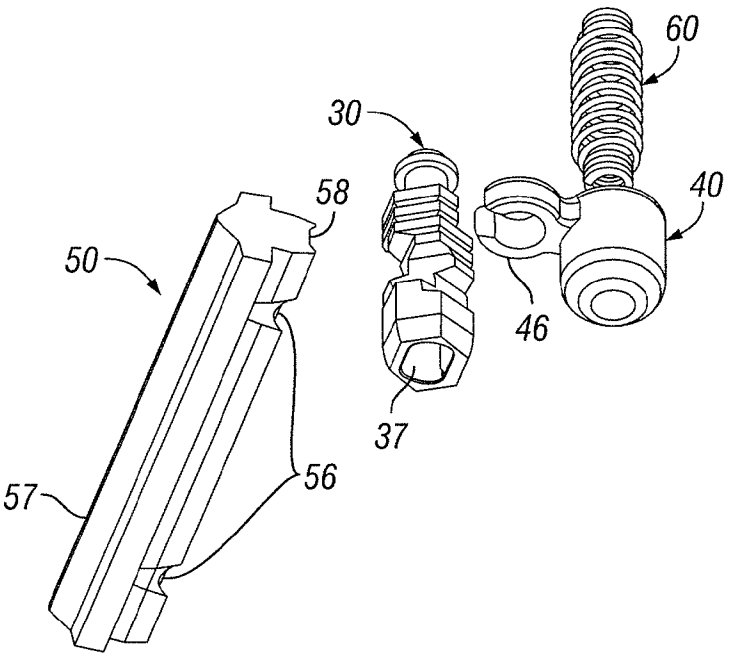
FIG. 29 is a bottom front schematic perspective view of a locking bar, locking bar interface, key follower and key follower spring of the present invention arrayed in an operative relationship with one another.

Still referring to FIGS. 5-7, and with further reference to FIGS. 29 and 30, the operative arrangement of the elements of the locking cylinder 10 of the present invention is displayed. FIG. 6 shows the plug assembly 14 of the present invention with a first valid key 84 inserted. FIG. 7 (with key 84 withdrawn) illustrates the elements in the locked or home position, as well as the operative association of locking bar 50 with cylinder body 12 and plug body 22. Here the cylinder wall-engaging portion 57 of the locking bar 50 is engaged with a mating longitudinal groove 86 formed in an interior surface 88 of cylinder body 12. The cylinder wall-engaging portion 57 and the groove 86 are so configured as to cause the locking bar 50 to cam out of the groove 86 in response to rotation of the plug assembly 14, when a valid key 84 is inserted, thereby raising the key follower 40 and its respective interface 30 to a vertical position aligning an unlocking cavity 35(*a*)-35(*f*) with the interface-engaging portion 58. As shown in FIG. 6, the interface-engaging portion 58 is shown misaligned with the unlocking cavities 35(*a*)-35(*f*) of the interface 30, thereby maintaining the elements of the lock cylinder 10 of the present invention in the home position or locked state until a first valid key 84 is inserted.

Figure 23:
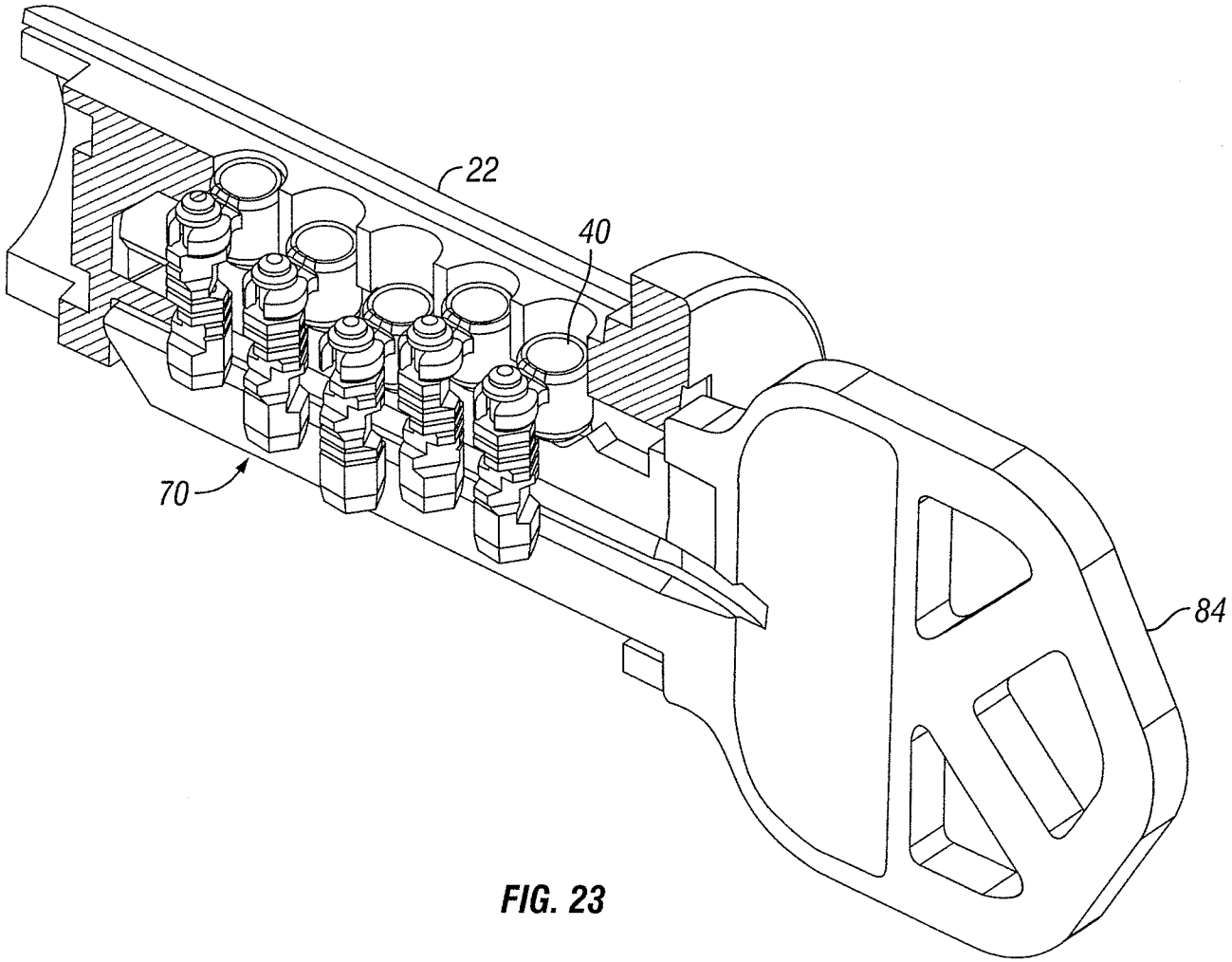
FIG. 23 is a partially cut-away perspective view of the plug assembly of the present invention, similar to FIG. 21, but with the key followers of the present invention moved to the respective unlocking position by insertion of a valid key.
Figure 24:
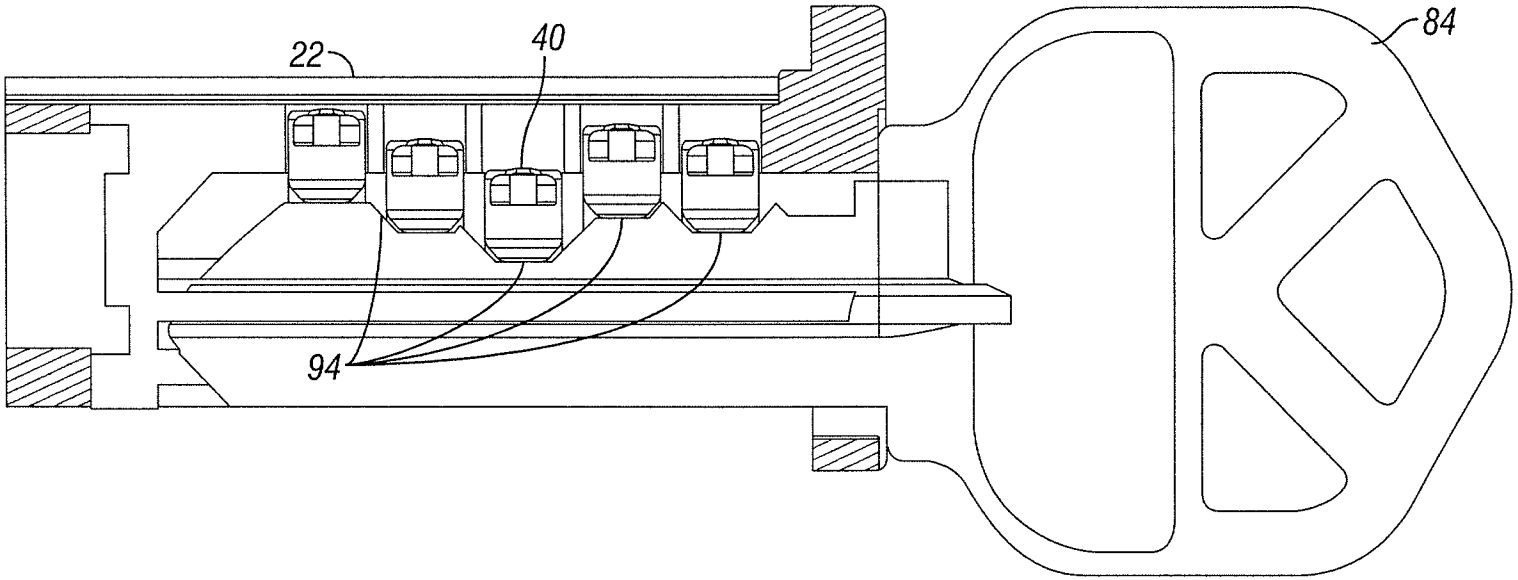
FIG. 24 is a partial side elevational view of the plug assembly of FIG. 23, with the locking bar interfaces of the present invention removed.
Figure 25:
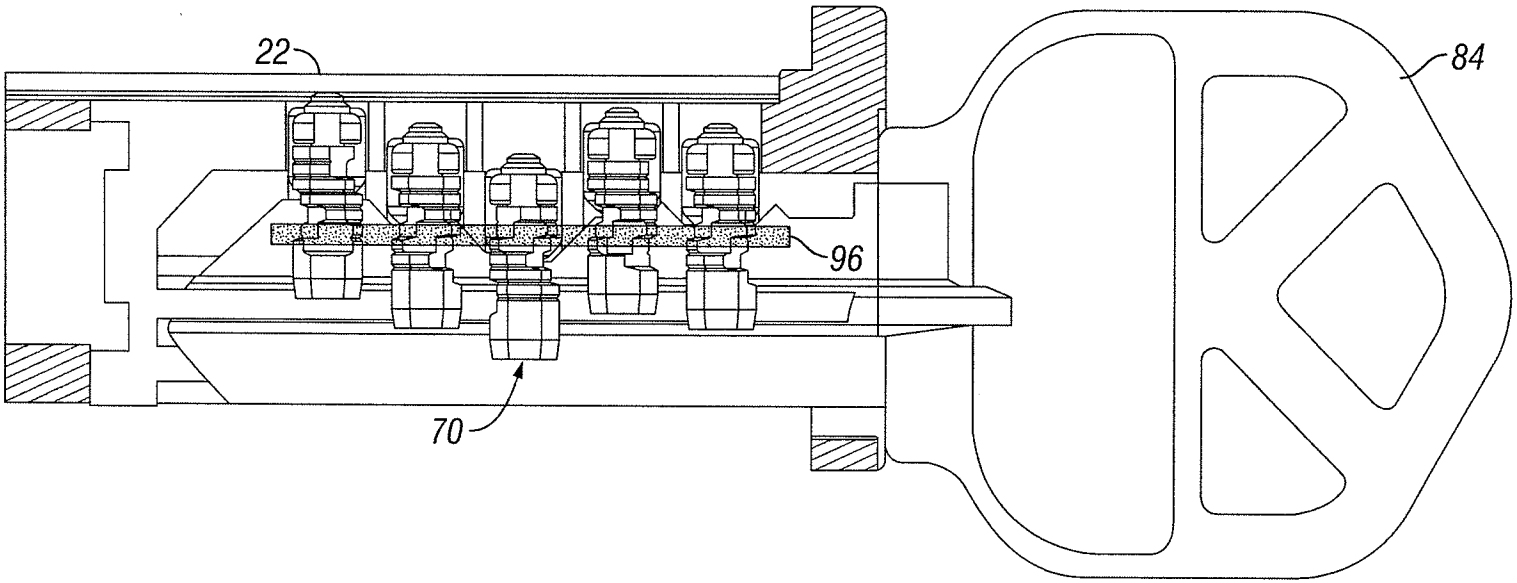
FIG. 25 is an enlarged partial side elevational detail view of the plug assembly of FIG. 24, with the locking bar interfaces of the present invention included, and illustrating the cut line of the unlocking cavities of the locking bar interfaces aligned with the locking bar of the present invention.

FIGS. 17-22 are additional views of key follower-interface subassemblies 70 in the plug body 22 in the home position or locked state. FIGS. 23-25 show the effect of inserting the first valid key 84 into the plug assembly 14, thereby engaging the array of key follower-interface subassemblies 70 shown as in FIGS. 16 and 20 with unlocking cavities 35(*a*)-35(*f*) being misaligned relative to the locking bar 50. The key cuts 94 formed in key 84 coact with key followers 40 to move them from the home position or locked state of FIG. 22 to the unlocked state shown in FIG. 24, As described above, this in turn moves respective key follower-interface subassemblies 70 to the position shown in FIGS. 23 and 25, where appropriate ones of respective unlocking cavities 35(*a*)-35(*f*) have become aligned with the locking bar 50, as represented by the cut line 96 shown in FIG. 25. With the locking bar 50 now being aligned with all of the appropriate unlocking cavities 35(*a*)-35(*f*) in the interfaces 30, the locking bar interface-engaging portion 58 is free to be cammed out of the longitudinal groove 86 in the interior cylinder surface 88 of lock cylinder body 12 by rotation of the key 84. The lock cylinder 10 of the present invention is now ready to be unlocked.

Figure 32:
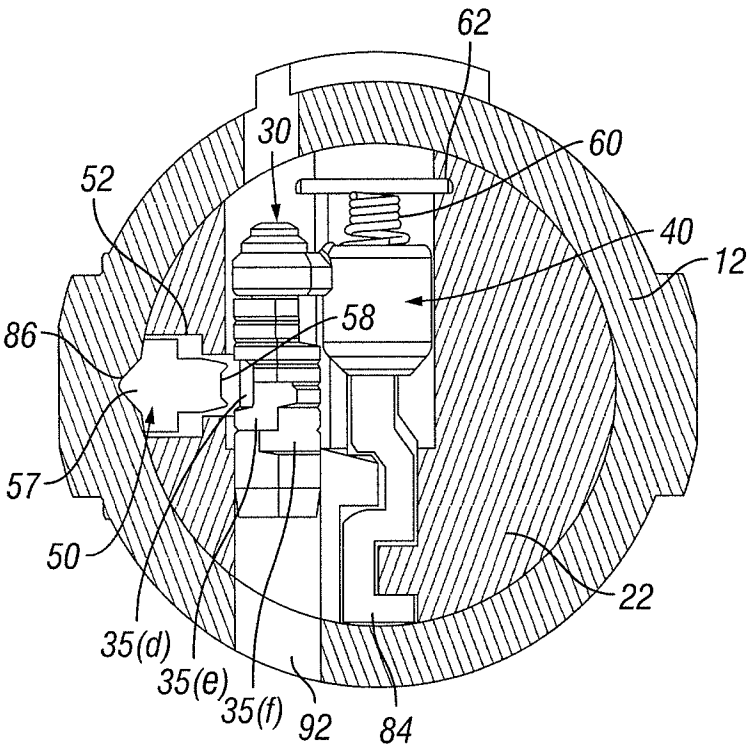
FIG. 32 is a partial cross-sectional view of a lock cylinder of the present invention, illustrating the lock cylinder of FIG. 31 with a valid key inserted.
Figure 31:
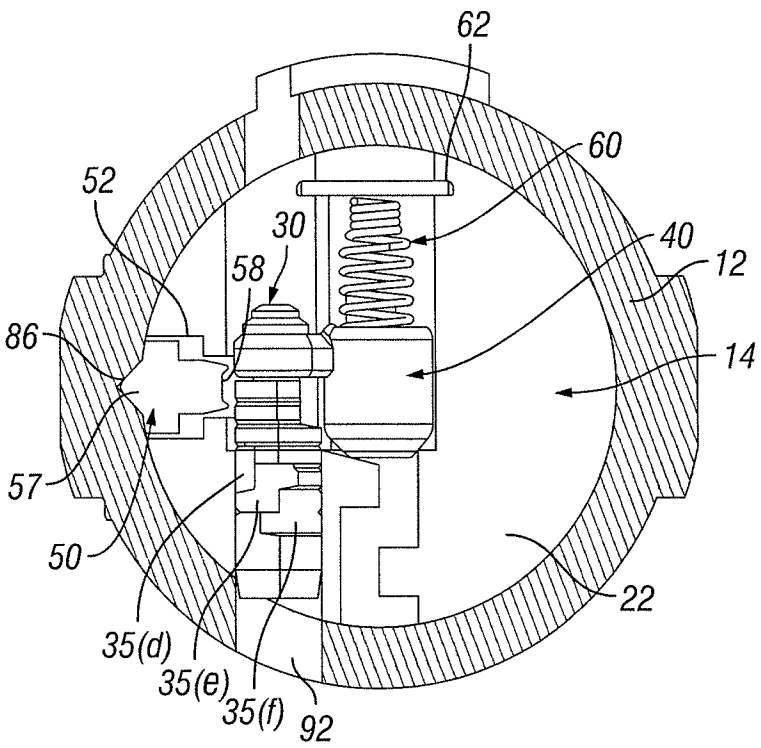
FIG. 31 is a partial cross-sectional view of a lock cylinder of the present invention, illustrating one key follower—locking bar interface subassembly and the cylinder in the locked state with no key inserted.
Figure 34:
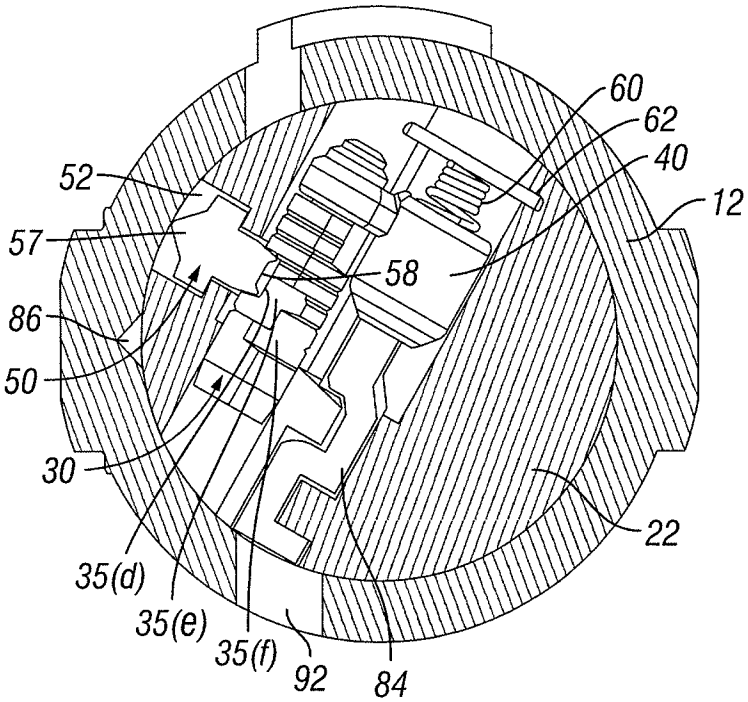
FIG. 34 is a partial cross-sectional view of a lock cylinder of the present invention, illustrating the lock cylinder of FIG. 33, the key having been able to continue rotation to unlock the lock cylinder.
Figure 33:
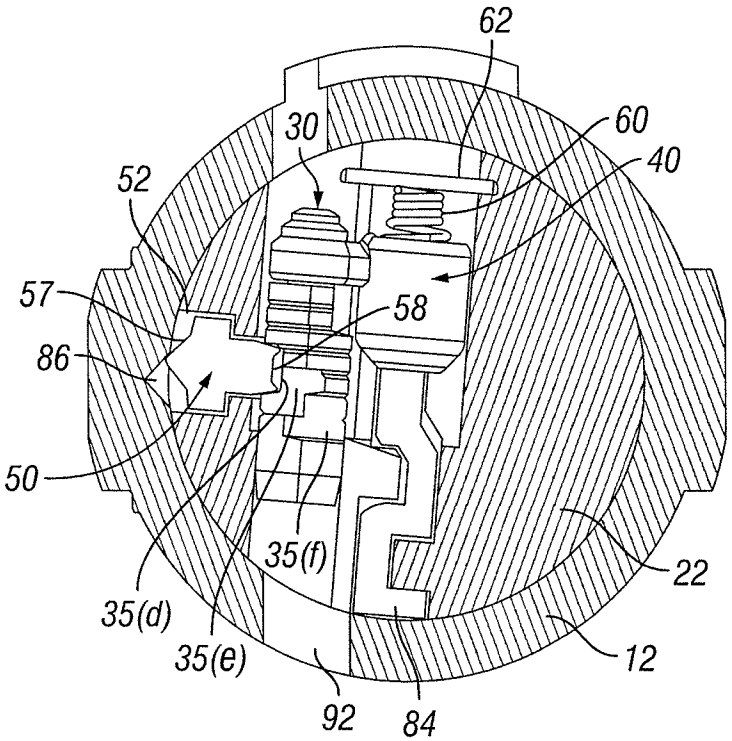
FIG. 33 is a partial cross-sectional view of a lock cylinder of the present invention, illustrating the lock cylinder of FIG. 32 with the key rotated, camming out the lock bar into the unlocking cavity of a locking bar interface of the present invention.

A method therefore according to the present invention for unlocking a rekeyable lock cylinder 10 of the present invention is illustrated in FIGS. 31-34. One key follower-interface subassembly 70 of the array of five will be used to demonstrate the behavior of all such subassemblies. FIG. 31 shows the components in the home or locked position, with unlocking recess 35(*d*) of interface 30 being aligned angularly but not vertically with locking bar 50, the angular orientation having been set to be compatible with the use of first valid key 84. In FIG. 32, key 84 has been inserted and has raised key follower 40 against the bias of key follower spring 60 to a predetermined elevation which in turn has raised interface 30 so that unlocking cavity 35(*d*) has now also become vertically aligned with locking bar 50. This alignment will now permit locking bar 50 to be cammed out of groove 86 by an initial clockwise rotation of the key 84, as shown in FIG. 33. Locking bar 50, now completely nestled in locking bar cavity 52, may be carried by plug assembly 14, throughout the rotation of the key 84 as it completes the unlocking process as shown in FIG. 34.

Having described the elements of the lock cylinder 10 of the present invention, it is now appropriate to explain a novel rekeying method afforded by the present invention.

First, however, it will be instructive to review FIGS. 7, 29 and 30 to see additional elements for aligning respective appropriate unlocking cavities 35(*a*)-35(*f*) of the interfaces 30 with the locking bar 50. They include a rekeying tool 90 having a non-circular portion 92 for engaging the mating non-circular cavity 37 formed in the interface 30. The rekeying tool 90 may be inserted through access apertures 92 formed in the cylinder body 12.

Figure 35A:
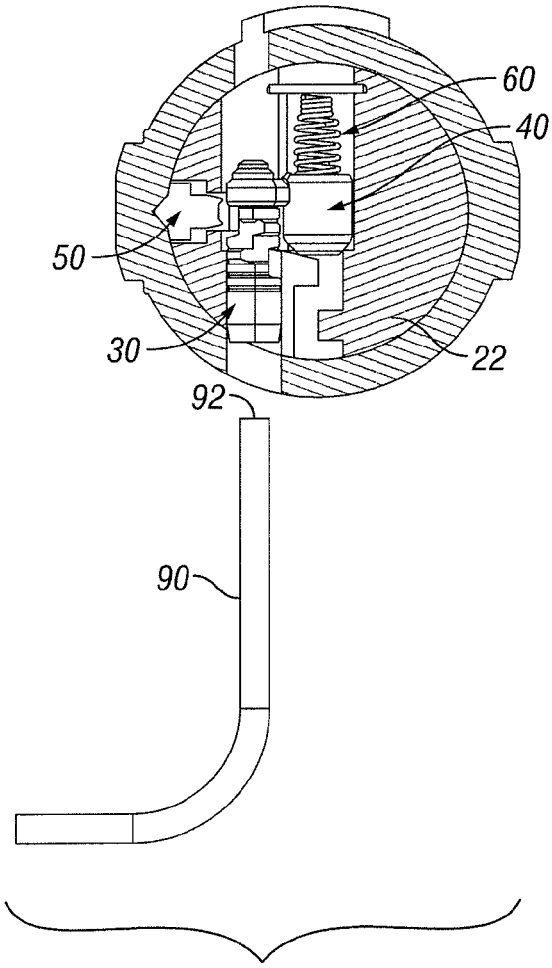
FIGS. 35A-35D are partial cross-sectional views of the lock cylinder of the present invention, illustrating a method according to the present invention for rekeying the lock cylinder.

Accordingly, a method according to the present invention for rekeying a lock cylinder 10 of the present invention is shown in FIGS. 35A-35D. FIG. 35A shows the rekeying tool 90 positioned and aligned below the tool cavity 37 formed in the bottom 38 of an interface 30, with the elements of the lock cylinder 10 of the present invention shown in the home position. The array of appropriate interface unlocking cavities 35(*a*)-35(*f*) was previously made compatible with a first valid key 84 (i.e., appropriate unlocking cavities 35(*a*)-35(*f*) are aligned angularly with the locking bar 50, and are ready to be aligned vertically, as well, by insertion of the first valid key).

Figure 35B:
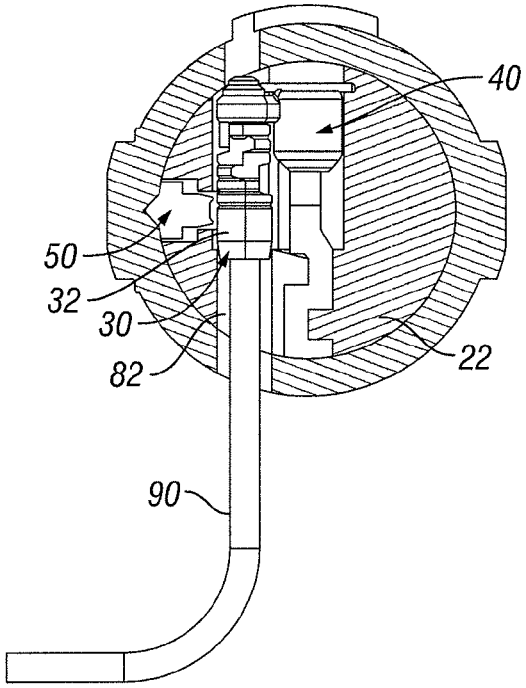
Figure 35C:
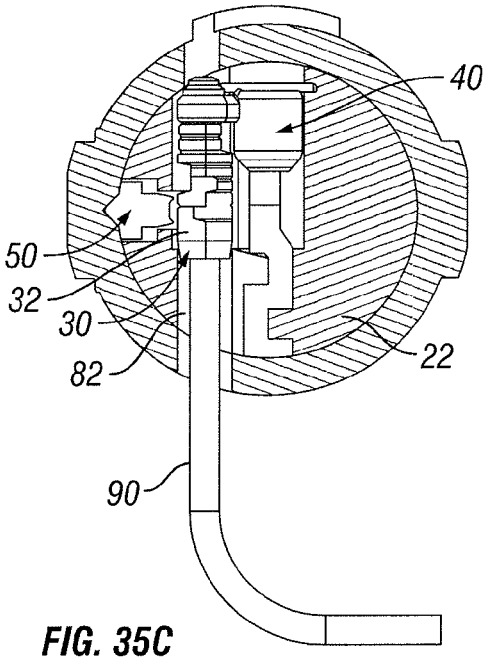
Figure 35D:
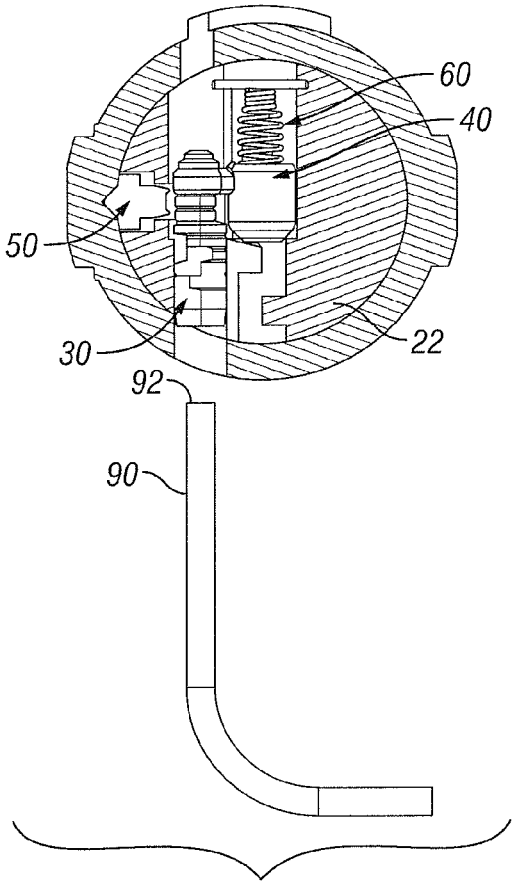
Figure 36:
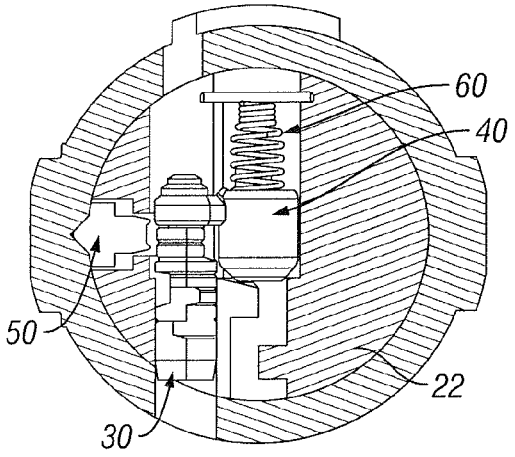
FIG. 36 is a partial cross-sectional view of the lock cylinder of the present invention illustrating the rekeyed lock in the home position with no key inserted.
Figure 37:
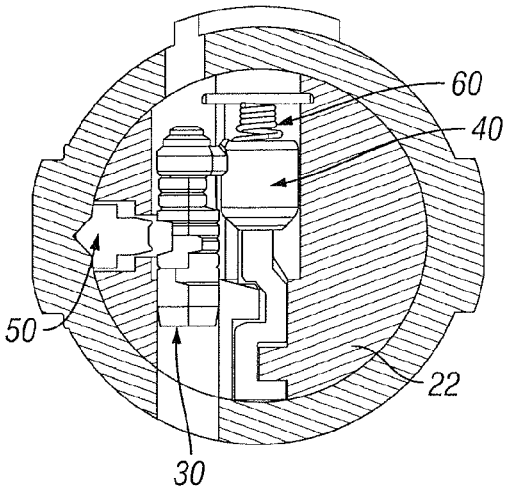
FIG. 37 is a partial cross-sectional view of the lock cylinder of FIG. 36, illustrating the insertion of a second valid key, the key having raised a locking bar interface of the present invention to the right height to be aligned with a locking bar of the present invention.

FIG. 35B shows the next step. The rekeying tool 90 has been inserted into the interface 30, and the interface 30 is pushed all the way up against the bias of key follower spring 60 so that the polygonal portion 32 of the interface 30 clears the polygonal cavity 82 formed in the plug body 22 and moves into the annular cavity 80, where the interface is free to rotate. As shown in FIG. 35C, while keeping the interface 30 all the way up, the rekeying tool is rotated to move the interface to a desired angular position relative to the locking bar 50. Thus, for this embodiment of the present invention, the interface 30 may be rotated 60°, 120°, 180°, 240° or 300° from its present angular orientation relative to the locking bar 50. This realigns a selected locking cavity 35(*a*), 35(*b*), 35(*c*), 35(*d*), 35(*e*), or 35(*f*) with the locking bar 50. Once this is done the rekeying tool 90 is pulled down and out of engagement with the interface 30. This allows the key follower spring 60 to cause the interface 30 to reengage with the polygonal cavity 82, thus once again moving it into a non-rotatable position, as shown in FIG. 35D. This completes the rekeying process, although these steps may be repeated with respect to one more or all of the remaining interfaces 30, if more security is desired. The rekeying method according to the present invention takes only a few seconds and, as is evident, does not require the insertion of a key to initiate or continue the rekeying process. FIG. 36 shows the rekeyed lock cylinder 10 of the present invention, with no key inserted, in the home position. FIG. 37 shows a second valid key 98 inserted in the lock cylinder 10 of the present invention, the second valid key being conformed to move the realigned key follower-interface subassembly 70 to the right height to allow the locking bar 50 to move into the appropriate unlocking recess 35 in the interface 30 when the key 98 is rotated.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A rekeyable lock cylinder comprising:

a lock cylinder body including a cylinder wall defining an interior surface with a longitudinally extending void;

a plug assembly rotatably disposed in a lock cylinder body, the plug assembly comprising:

a plug body having a key face and a keyway extending into the plug body from the key face;

a plurality of key followers positioned along the keyway and being linearly movable relative to the plug body, wherein the key followers are biased toward a home position;

a plurality of first locking elements movable with respect to the plug body, wherein each first locking element of the plurality first locking elements is rotatably coupled with a respective key follower of the plurality of key followers to move linearly concomitant with the respective key follower;

a second locking element operatively associated with the plug body and the lock cylinder body, wherein the second locking element includes a cylinder wall-engagement portion configured to engage the longitudinally extending void of the cylinder wall and an interface engaging portion configured to engage the plurality of first locking elements, wherein the second locking element is biased towards the longitudinally extending void of the cylinder wall;

wherein each first locking element of the plurality of first locking elements defines a plurality of angularly spaced unlocking cavities each configured to receive a portion of the interface engaging portion of the second locking element; and wherein alignment of at least one unlocking cavity of each first locking element with the interface engaging portion of the second locking element allows the cylinder wall-engagement portion of the second locking element to move out of the void in the cylinder wall;

wherein each of the first locking elements are selectively rotatable to angularly align a selected unlocking cavity with the second locking element to facilitate rekeying of the rekeyable lock cylinder.

2. The rekeyable lock cylinder of claim 1, wherein at least a portion of the plurality of first locking elements includes a cylindrical portion and a portion with a non-circular cross-section.

3. The rekeyable lock cylinder of claim 2, wherein the cylindrical portion is rotatably coupled with a respective key follower of the plurality of key followers.

4. The rekeyable lock cylinder of claim 3, wherein the cylindrical portion has a reduced diameter portion coupled with a respective key follower of the plurality of key followers.

5. The rekeyable lock cylinder of claim 3, wherein at least a portion of the key followers include a connector having annular arms coupled with the cylindrical portion.

6. The rekeyable lock cylinder of claim 3, wherein the cylindrical portion is coupled with a respective key follower using a toothless connection.

7. The rekeyable lock cylinder of claim 2, wherein the non-circular portion of the first locking elements includes a polygonal cross-sectional shape.

8. The rekeyable lock cylinder of claim 7, wherein the polygonal cross-sectional shape is a triangle, quadrilateral, pentagon, hexagon, heptagon, octagon, nonagon, or decagon.

9. The rekeyable lock cylinder of claim 7, wherein the non-circular portion has a plurality of faces, wherein the plurality of faces includes a plurality of substantially parallel grooves.

10. The rekeyable lock cylinder of claim 2, wherein the plug body defines a plurality of interface cavities dimensioned to receive the plurality of first locking elements, wherein the interface cavities extend transverse to a longitudinal axis of the plug body.

11. The rekeyable lock cylinder of claim 10, wherein the interface cavities are shaped to conform to the non-circular portion of the first locking elements.

12. The rekeyable lock cylinder of claim 11, wherein the non-circular portion of the first locking elements are movable between a first position out of the interface cavities and a second position received in the interface cavities, wherein the first locking elements are freely rotatable in the first position and non-rotatable in the second position.

13. The rekeyable lock cylinder of claim 12, wherein the plug body includes a plurality of tool cavities each aligned with a respective first locking element to access the first locking elements with a rekeying tool.

14. The rekeyable lock cylinder of claim 10, wherein the non-circular portion of the first locking elements is urged into the interface cavities by a biasing member.

15. A rekeyable lock cylinder comprising:

a lock cylinder body;

a plug assembly rotatably disposed in a lock cylinder body, the plug assembly comprising:

a plug body having a key face and a keyway extending into the plug body from the key face;

a plurality of key followers positioned along the keyway and being linearly movable relative to the plug body, wherein the key followers are biased toward a home position;

a plurality of first locking elements linearly movable with respect to the plug body, wherein each first locking element of the plurality first locking elements includes a reduced diameter portion rotatably connected with a respective key follower of the plurality of key followers to move linearly concomitant with the respective key follower, wherein each of the first locking elements includes a portion with a polygonal shape movable between a non-rotatable position received in an interface cavity defined in the plug body and a rotatable position out of the interface cavity;

a second locking element operatively associated with the plug body and the lock cylinder body; and wherein each of the first locking elements are selectively rotatable when the polygonal portion is moved to the rotatable position to angularly position a selected unlocking cavity of a plurality of unlocking cavities defined in each first locking element to be aligned with the second locking element to facilitate rekeying of the rekeyable lock cylinder.

16. The rekeyable lock cylinder of claim 15, wherein at least a portion of the key followers include a connector having annular arms extending therefrom.

17. The rekeyable lock cylinder of claim 16, wherein the annular arms couple the key followers with the reduced diameter portion of the first locking elements.

18. The rekeyable lock cylinder of claim 15, wherein the polygonal portion includes a plurality of faces, wherein the plurality of faces includes a plurality of substantially parallel grooves.

19. The rekeyable lock cylinder of claim 15, wherein the interface cavities are shaped to conform to the polygonal portion of the first locking elements.

20. The rekeyable lock cylinder of claim 15, wherein the polygonal portion of the first locking elements is urged into the interface cavities by a biasing member.

21. The rekeyable lock cylinder of claim 15, wherein the plug body includes a plurality of tool cavities each aligned with a respective first locking element to access a lower portion of the first locking elements with a rekeying tool.

22. A rekeyable lock cylinder comprising:

a lock cylinder body;

a plug assembly rotatably disposed in a lock cylinder body, the plug assembly comprising:

a plug body having a key face and a keyway extending into the plug body from the key face;

a plurality of key followers positioned along the keyway and being linearly movable relative to the plug body, wherein the key followers are biased toward a home position; and a plurality of first locking elements movable with respect to the plug body, wherein each first locking element of the plurality first locking elements is rotatably connected with a respective key follower of the plurality of key followers to move linearly concomitant with the respective key follower;

a second locking element operatively associated with the plug body and the lock cylinder body; and wherein each of the first locking elements are selectively rotatable to facilitate rekeying of the rekeyable lock cylinder.

23. The rekeyable lock cylinder of claim 22, wherein at least a portion of the plurality of first locking elements includes a cylindrical portion and a portion with a polygonal cross-section.

24. The rekeyable lock cylinder of claim 23, wherein the cylindrical portion is rotatably coupled with a respective key follower of the plurality of key followers.

25. The rekeyable lock cylinder of claim 24, wherein the cylindrical portion has a reduced diameter portion coupled with a respective key follower of the plurality of key followers.

26. The rekeyable lock cylinder of claim 23, wherein at least a portion of the key followers include a connector having annular arms with a gap therebetween.

27. The rekeyable lock cylinder of claim 26, wherein the annular arms couple the key followers with the cylindrical portion of the first locking elements.

28. The rekeyable lock cylinder of claim 23, wherein the polygonal cross-sectional shape is a triangle, quadrilateral, pentagon, hexagon, heptagon, octagon, nonagon, or decagon.

29. The rekeyable lock cylinder of claim 23, wherein the polygonal cross-sectional shape has a plurality of faces, wherein the plurality of faces includes a plurality of grooves.

30. The rekeyable lock cylinder of claim 23, wherein the plug body defines a plurality of interface cavities dimensioned to receive the plurality of first locking elements, wherein the interface cavities extend transverse to a longitudinal axis of the plug body.

31. The rekeyable lock cylinder of claim 30, wherein the interface cavities are shaped to conform to the polygonal cross-sectional portion of the first locking elements.

32. The rekeyable lock cylinder of claim 31, wherein the polygonal cross-sectional portion of the first locking elements are movable between a first position out of the interface cavities and a second position received in the interface cavities, wherein the first locking elements are freely rotatable in the first position and non-rotatable in the second position.

33. The rekeyable lock cylinder of claim 32, wherein the polygonal cross-sectional portion of the first locking elements is urged into the interface cavities with a biasing member.

34. The rekeyable lock cylinder of claim 23, wherein the plug body includes a plurality of tool cavities each aligned with a respective first locking element to access a lower portion of the first locking elements with a rekeying tool.

35. A method of rekeying a rekeyable lock cylinder, comprising the steps of:

providing a plug assembly rotatably disposed in a lock cylinder body, wherein the plug assembly includes a plurality of interface members associated with a plurality of key followers disposed in the plug assembly, wherein the plurality of interface members are linearly movable along an axis transverse to a longitudinal axis of the plug assembly;

rotating one or more of the interface members about the axis transverse to the longitudinal axis of the plug assembly from a first angular position to a second angular position; and maintaining an angular position of the interface members.

36. The method of claim 35, wherein the interface members include a plurality of angularly spaced unlocking cavities, wherein the first angular position corresponds with a first unlocking cavity and the second angular position corresponds with a second unlocking cavity.

37. The method of claim 35, wherein each of the first locking elements includes a portion with a non-circular cross-sectional shape movable between a non-rotatable position received in an interface cavity defined in the plug assembly and a rotatable position out of the interface cavity in which the first locking elements are freely rotatable.

38. The method of claim 37, further comprising the step of moving the first locking elements from the non-rotatable position to the rotatable position in order to rotate the interface member from the first angular position to the second angular position.

39. The method of claim 38, wherein the moving step is performed by inserting a tool into the interface cavity.

40. The method of claim 39, wherein the tool is inserted through a cylindrical wall of the plug assembly.

* * * * *